US007171811B1

(12) United States Patent
Berchowitz et al.

(10) Patent No.: US 7,171,811 B1
(45) Date of Patent: Feb. 6, 2007

(54) MULTIPLE-CYLINDER, FREE-PISTON, ALPHA CONFIGURED STIRLING ENGINES AND HEAT PUMPS WITH STEPPED PISTONS

(75) Inventors: David M. Berchowitz, Athens, OH (US); Yong-Rak Kwon, Athens, OH (US)

(73) Assignee: Global Cooling BV, Helmond (NL)

( * ) Notice: Subject to any disclaimer, the term of this patent is extended or adjusted under 35 U.S.C. 154(b) by 0 days.

(21) Appl. No.: 11/238,287

(22) Filed: Sep. 29, 2005

Related U.S. Application Data

(60) Provisional application No. 60/717,319, filed on Sep. 15, 2005.

(51) Int. Cl.
*F01B 29/10* (2006.01)

(52) U.S. Cl. ..... 60/525; 60/517
(58) Field of Classification Search ..... 60/517, 60/520, 525
See application file for complete search history.

(56) References Cited

U.S. PATENT DOCUMENTS

| | | | | |
|---|---|---|---|---|
| 4,161,866 | A | 7/1979 | Kamiyama | |
| 4,199,945 | A * | 4/1980 | Finkelstein | 60/520 |
| 4,389,844 | A * | 6/1983 | Ackermann et al. | 60/517 |
| 4,498,298 | A * | 2/1985 | Morgan | 60/525 |
| 5,109,673 | A * | 5/1992 | Vitale | 60/520 |
| 5,317,878 | A | 6/1994 | Bradshaw et al. | |
| 5,456,076 | A * | 10/1995 | Zornes | 60/525 |

OTHER PUBLICATIONS

Animated Engines, "Two Cylinder Stirling Engine", Copyright 2000, Keveney.com, Sep. 9, 2005, pp. 1-3, http://www.keveney.com/Vstirling.html.

(Continued)

*Primary Examiner*—Hoang Nguyen
(74) *Attorney, Agent, or Firm*—Frank H. Foster; Kremblas, Foster, Phillips & Pollick

(57) ABSTRACT

An improved, free-piston, Stirling machine having at least three pistons series connected in an alpha Stirling configuration. Each cylinder is stepped so that it has a relatively larger diameter interior wall and a coaxial, relatively smaller diameter interior wall. Each piston is also stepped so that it has a first component piston having an end face facing in one axial direction and matingly reciprocatable in the smaller diameter cylinder wall and a second component piston having an end face facing in the same axial direction and matingly reciprocatable in the larger diameter, cylinder wall. One of the piston end faces bounds the compression space and the other end face bounds the expansion space. Preferably, each stepped piston has peripheral, cylinder walls that are axially adjacent and joined at a shoulder forming the end face of the larger diameter component piston. Stirling machines with these stepped features are also arranged in various opposed and duplex configurations, including arrangements with only one load or prime mover for each opposed pair of pistons. Improved balancing or vibration reduction is obtained by connecting expansion and compression spaces of a four cylinder in-line arrangement in a 1, 3, 2, 4 series sequence. Three cylinder embodiments provide a highly favorable volume phase angle of 120° and are advantageously physically arranged with three, parallel, longitudinal axes of reciprocation at the apexes of an equilateral triangle.

19 Claims, 6 Drawing Sheets

OTHER PUBLICATIONS

Stirling Engine Configurations—updated Dec. 19, 2004, "Stirling Engines—Mechanical Configurations", Sep. 9, 2005, pp. 1-4 http://www.ent.ohiou.edu/-urieli/stirling/engines/engines.html.

Wikipedia, the free encyclopedia, "Stirling engine", Sep. 9, 2005, p. 1-6, http://en.wikipedia.org/wiki/stirling¯engine.

White, Maurice A., "Combining The Best In Free-Piston And Kinematic Stirling Machines: The Multi-Cylinder Free-Piston Stirling Engine", Commercial developments, Sep. 7-9, 2005, pp. 17-29.

White, Maury and Brehm, Peter, "The Multi-Cylinder Free-Piston Stirling Engine-Taking Performance to a New Level-", Presentation to Interagency Advanced Power Group, May 24, 2005, pp. 1-24.

* cited by examiner

Key
A: Acceptor
R: Regenerator
K: Rejector

Key
$A$ Piston area
$A_R$ Rod area

Fig. 6
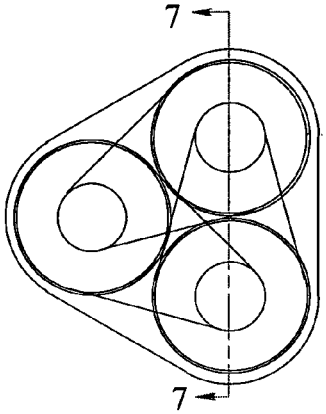
Fig. 7
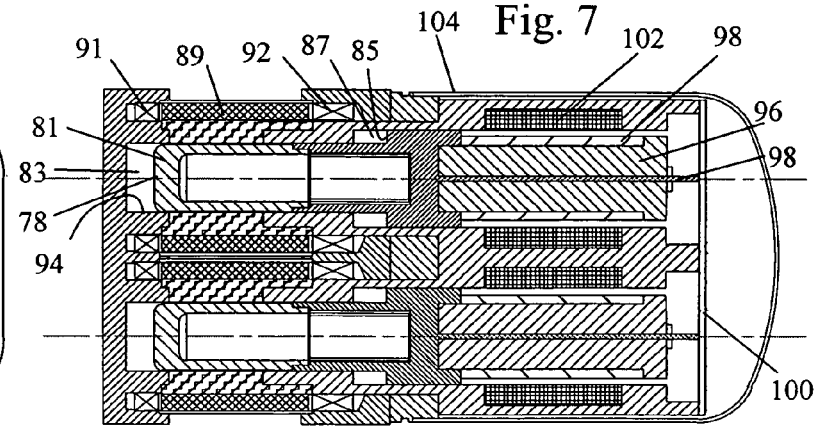
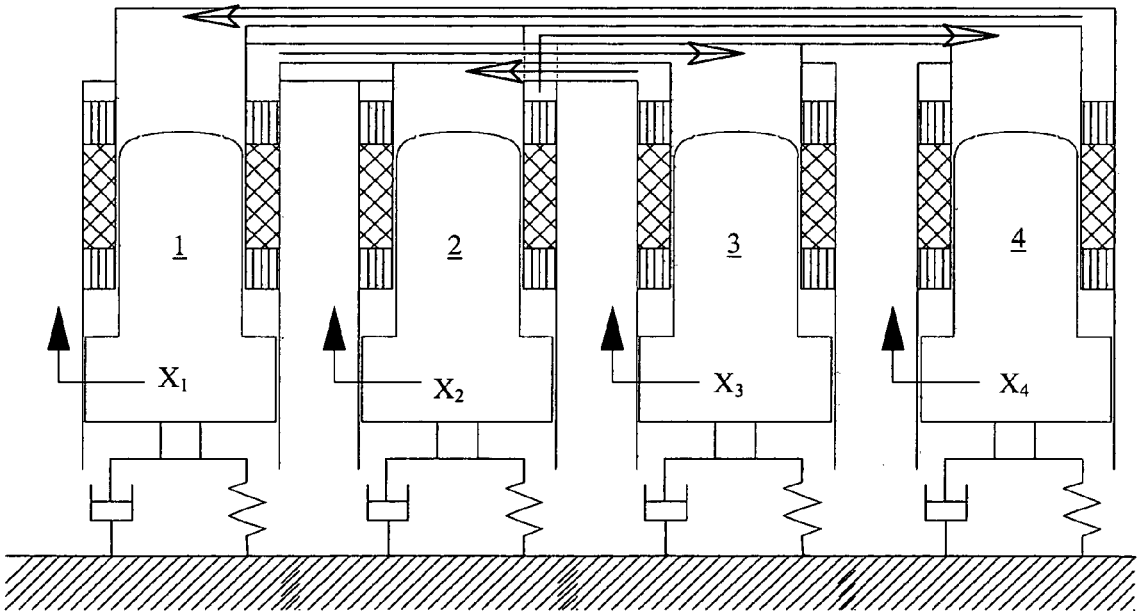
Fig. 8
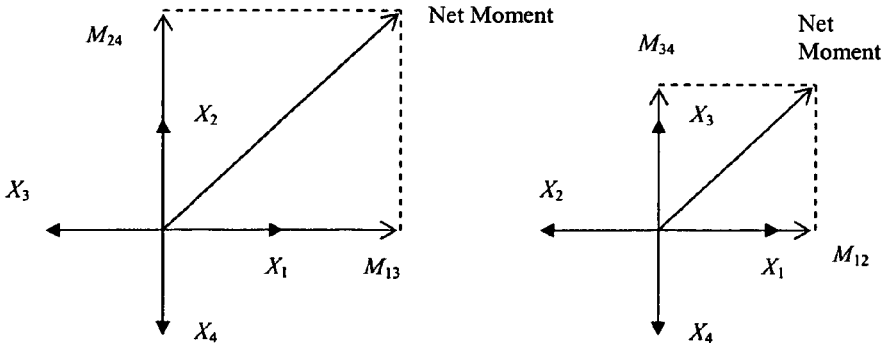
Fig. 9

Fig. 10
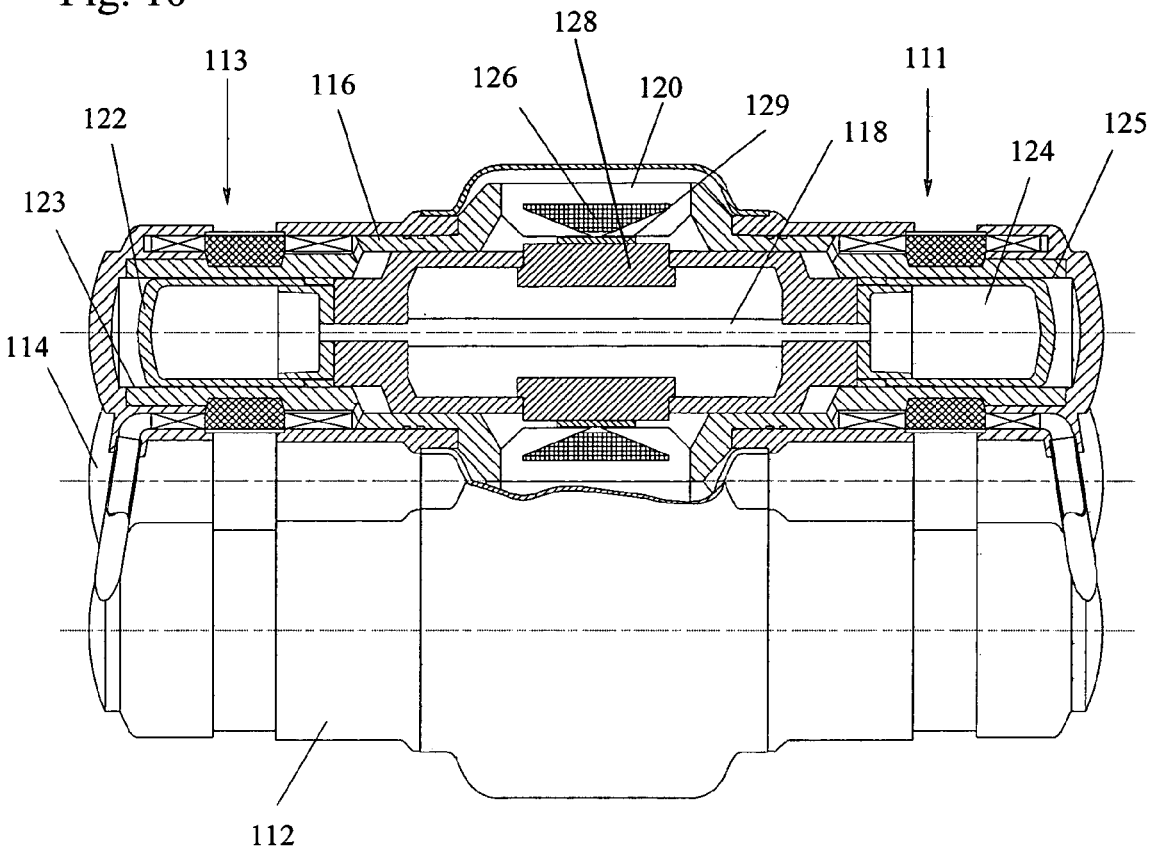
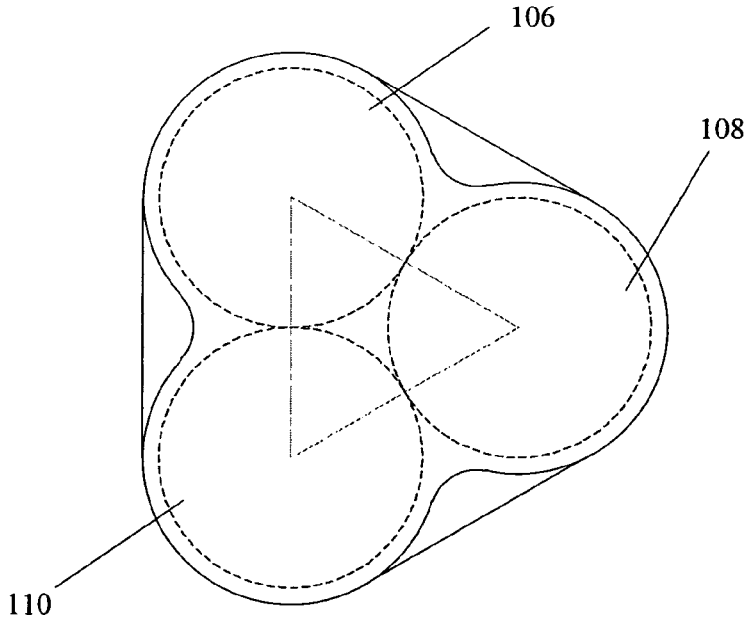
Fig. 11

MULTIPLE-CYLINDER, FREE-PISTON, ALPHA CONFIGURED STIRLING ENGINES AND HEAT PUMPS WITH STEPPED PISTONS

CROSS-REFERENCES TO RELATED APPLICATIONS

This application claims the benefit of U.S. Provisional Application No. 60/717,319 filed Sep. 15, 2005.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field of the Invention

This invention relates generally to Stirling engines and heat pumps and more particularly to improvements in free-piston, multi-cylinder Stirling engines and heat pumps arranged in an alpha configuration.

2. Description of the Related Art

Stirling machines have been known for nearly two centuries but in recent decades have been the subject of considerable development because of advantages they offer. In a Stirling machine, a working gas is confined in a working space comprised of an expansion space and a compression space. The working gas is alternately expanded and compressed in order to either do work or to pump heat. Stirling machines cyclically shuttle a working gas between the compression space and the expansion space which are connected in fluid communication through an accepter, regenerator and rejecter. The shuttling is commonly done by pistons reciprocating in cylinders and cyclically changes the relative proportion of working gas in each space. Gas that is in the expansion space, and/or gas that is flowing into the expansion space through a heat exchanger (the accepter) between the regenerator and the expansion space, accepts heat from surrounding surfaces. Gas that is in the compression space, and/or gas that is flowing into the compression space through a heat exchanger (the rejecter) between the regenerator and the compression space, rejects heat to surrounding surfaces. The gas pressure is essentially the same in both spaces at any instant of time because they are interconnected through a path having a relatively low flow resistance. However, the pressure of the working gas in the work space as a whole varies cyclically. When most of the working gas is in the compression space, heat is rejected from the gas. When most of the working gas is in the expansion space, the gas accepts heat. This is true whether the machine is working as a heat pump or as an engine. The only requirement to differentiate between work produced or heat pumped, is the temperature at which the expansion process is carried out. If this expansion process temperature is higher than the temperature of the compression space then the machine is inclined to produce work and if this expansion process temperature is lower than the compression space temperature, then the machine will pump heat from a cold source to a warm sink.

Stirling machines can therefore be designed to use the above principles to provide either (1) an engine having pistons driven by applying an external source of heat energy to the expansion space and transferring heat away from the compression space, or (2) a heat pump having pistons cyclically driven by a prime mover for pumping heat from the expansion space to the compression space. The heat pump mode permits Stirling machines to be used for cooling an object in thermal connection to its expansion space, including to cryogenic temperatures, or heating an object, such as a home heating heat exchanger, in thermal connection to its compression space. Therefore, the term Stirling "machine" is used to generically include both Stirling engines and Stirling heat pumps.

Until 1965, Stirling machines were constructed as kinematically driven machines meaning that the pistons are connected to each other by a mechanical linkage, typically connecting rods and crankshafts. The free piston Stirling machine was then invented by William Beale. In the free piston Stirling machine, the pistons are not connected to a mechanical drive linkage. Free-piston Stirling machines are constructed as mechanical oscillators and one of its pistons, conventionally identified as a displacer, is driven by the working gas pressure variations in the machine. They offer numerous advantages including the control of their frequency and phase and their lack of a requirement for a seal between moving parts to prevent the mixing of working gas and lubricating oil.

Stirling machine have been developed in a variety of configurations. A common form of the modern Stirling engine is the alpha configuration, also referred to as the Rinia, Siemens or double acting arrangements. In the alpha configuration, there are at least two pistons in separate cylinders and the expansion space bounded by each piston is connected to a compression space bounded by another piston in another cylinder. These connections are arranged in a series loop connecting the expansion and compression spaces of multiple cylinders. The connection of each expansion space to the compression space associated with another piston typically includes, in series: (1) a heat exchanger for applying heat to the working gas, (2) a regenerator and (3) a heat exchanger for removing rejected heat from the working gas. Their expansion and compression spaces have been interconnected by identical length passages resulting in a box-four arrangement that is illustrated in FIG. 1. More specifically, FIG. 1 shows a conventional, alpha configured, box-four arrangement of four pistons 10 slidable in four parallel cylinders 12. An expansion space 14 of each cylinder 12 is connected to a compression space 16 of another cylinder 12 to form a series connected, closed loop. Each connection is through a series connected: (1) accepter heat exchanger A that accepts heat from an external source and transfers it to the working gas in the expansion space 14; (2) a regenerator R; and (3) a rejecter heat exchanger K that transfers heat rejected from the compression space 16 and rejects it to an external mass. The conventional art has configured these machines in this box-four arrangement in the kinematic versions of this machine. This arrangement is unduly restrictive by requiring four moving parts plus the attendant crank mechanisms and by requiring that the cylinders be set up at each corner of a square.

Generally, alpha Stirling machines have been constructed as kinematically driven machines. The phasing of the crankshaft throws have been such that the relative phasing between the pistons is always 90°. This has limited the power control at a given speed to mean pressure adjustment or stroke control.

William Beale suggested a free-piston, alpha configuration machine in 1976. However, as far as is known, no arrangements of multiple-cylinder, free-piston, Stirling machines have been disclosed other than the simple four cylinder one originally suggested by Beale. The advantages of the free-piston version of the alpha machine are the advantages that accrue to the free-piston arrangement, namely: no oil lubrication, no mechanism components, simple implementation of gas bearings, modulation by stroke adjustment and hermetic sealing of the machine against working gas leakage. The alpha arrangement has always been seen as an overly complicated implementation of the free-piston Stirling when compared to the conventional displacer-piston or beta configuration.

For completeness, the second Stirling configuration is the Beta Stirling configuration characterized by a displacer and piston in the same cylinder. The third is the gamma Stirling configuration characterized by locating the displacer and piston in different cylinders. The present invention deals with alpha configuration, free-piston Stirling machines.

The conventional layout of a single $n^{th}$ element of an alpha configured Stirling machine in free-piston mode is shown in FIG. 2. A piston 20 is matingly slidable in a cylinder 22 and bounds an expansion space 24 at it upper face 26. A piston rod 28 extends through a bearing 30 into connection with a spring 32 and a symbolic dashpot 34 to represent damping. The annular end face 36 of the piston 20 bounds a compression space 38. A compression space port 40 connects to the series connected heat exchangers and regenerator of another similar element and through them to the expansion space of another cylinder. A port 42 leads from the series connected heat exchangers 44 and 46 and regenerator 48 to the compression space of another cylinder. FIG. 2 represents only the Stirling machine. A load is also connected to the piston rod 28 in the case of a Stirling engine and a prime mover is connected to the piston rod 28 in the case of a Stirling heat pump. The arrows leading from the piston and pointing upwardly in FIG. 2, as well as similar arrows in other Figures, designate the directional convention for positive piston displacement or stroke.

It is clear and generally understood that the alpha machines may be compounded in the multi-piston forms shown in FIG. 3 to have up to five cylinders connected together as described, although there could be more. Alongside each multi-piston example of FIG. 3 is a phasor diagram illustrating the cyclic piston motion and the cyclic expansion and compression space volumes of the associated example. The phase angle between the expansion space volume and the compression space volume in a Stirling machine is of critical importance because power and efficiency are a function of this phase angle. In early alpha Stirling machines, the volume phase angle was fixed at 90° by the orientation of the cylinders and connection of the pistons through connecting rods to a crank. However, for any Stirling machine, the preferred volume phase angle is within the range of 90° to 140°. This can be seen with reference to FIG. 14 which shows graphs of power and efficiency as a function of volume phase angle. It is desirable to operate the Stirling machine near the peaks of both the efficiency graph and the power graph. Lower and higher volume phase angles result in compromised efficiency and power. The poorer performance at the lower volume phase angles is due to high flow losses, high hysteresis losses and poor capacity (power or heat lift) per unit volume. The most favorable phase angle is generally around 120°. Volume phase angle is a function of the relationships of the expansion space and compression space volume phases to piston motion. Those relationships are a function of the machine structures and therefore the volume phase angle between the expansion space volume and a connected compression space volume is a function of machine structure.

In the phasor diagrams of FIG. 3, the volume phase angle $\alpha$ is shown in each case for a single set of expansion and compression space volume variations and would be the same for the other sets in the same example. By convention, $\alpha$ is the angle by which the expansion space volume leads the compression space volume. In the case of the conventional construction illustrated in FIGS. 1–3, the expansion space volume variations are in anti-phase with the piston motions while the compression space volume variations are in phase with the piston motions. As shown in the phasor diagrams of FIG. 3, a three-cylinder version of the conventional alpha compounding would have a poor volume phase angle at 60°. A four cylinder version would have a volume phase angle of 90° and a five cylinder version would have a volume phase angle of 108°. In order to obtain a volume phase angle of 120°, with the conventional alpha configuration, six cylinders would be needed.

In addition to the desirability of attaining a highly efficient volume phase angle, it is also desirable to reduce the number of component parts required for a Stirling machine and to minimize its weight and volume. Each beta Stirling configuration has two essential moving parts and in most cases also needs to be balanced, for example by a resonant balance mass that is attached to the casing. The alpha configuration is seen to require four essential moving parts, four pistons, in order to have an acceptable phase angle. A secondary difficulty of the alpha free-piston configuration is that it requires four linear alternators (or motors, in the case of a heat pump) because one is needed for each piston. Linear alternators have been somewhat bulky compared to their rotating counterparts and this has led to a feeling in the art that the alpha machine may be bulky and the cylinders inconveniently far from each other leading to a heavy machine. The balancing of a conventional alpha configuration is also not trivial and does not seem to have been addressed in the open literature.

An ideal solution to the alpha free-piston complexity would be a device that: improves the power to weight ratio of free-piston Stirling machinery without additional complication and thereby reduces the cost of the device; reduces the number of moving parts; provides a compact means for connecting a load to the machine so that the cylinders are not spaced too far apart; and provides a simple means of balance or of reducing the out of balance forces. The proposed invention appears to reduce or solve these problems in a simple and practical manner.

BRIEF SUMMARY OF THE INVENTION

The invention is an improved, free-piston, Stirling machine of the type having each piston reciprocatable in an associated mating cylinder and having each piston and cylinder bounding an expansion space and a compression space, the spaces being connected in an alpha Stirling configuration. In the improvement, there are at least three piston/cylinder elements and each cylinder is formed as a stepped cylinder having a larger diameter interior wall and a coaxial, smaller diameter interior wall. Each piston is a stepped piston comprising a first component piston having an end face facing in one axial direction and matingly reciprocatable in the smaller diameter cylinder wall and a second component piston having an end face facing in the same axial direction and matingly reciprocatable in the larger diameter, cylinder wall. One of those piston end faces bounds the compression space and the other bounds the expansion space. Preferably, the stepped piston has exterior, cylindrical walls that are axially adjacent and joined at a shoulder forming the end face of the larger diameter component piston. This piston and cylinder configuration allows a three piston, alpha configured, Stirling machine to have an optimum volume phase angle, with reduced weight and quantity of parts.

BRIEF DESCRIPTION OF THE SEVERAL VIEWS OF THE DRAWINGS

FIG. 6 is an end view of a three cylinder, alpha configured Stirling machine embodying the present invention.

FIG. 7 is a view in section of the machine illustrated in FIG. 6 taken substantially along the line 7—7 of FIG. 6.

FIG. 8 is diagram illustrating a four-piston alternative embodiment of the invention in which the expansion and compression spaces are connected to minimize vibration.

FIG. 9 is a pair of phasor diagrams illustrating the out-of-balance moment for the embodiment of FIG. 8 and a similar alternative embodiment.

FIG. 10 is a view partially in section illustrating an opposed alpha configuration embodying the present invention and adaptable to either a duplex in which one side is an engine and the other a heat pump or a duplicate cylinder set arrangement driving (or being driven by) three linear alternators (or motors).

FIG. 11 is an end view of the embodiment illustrated in FIG. 10.

Figure 1:
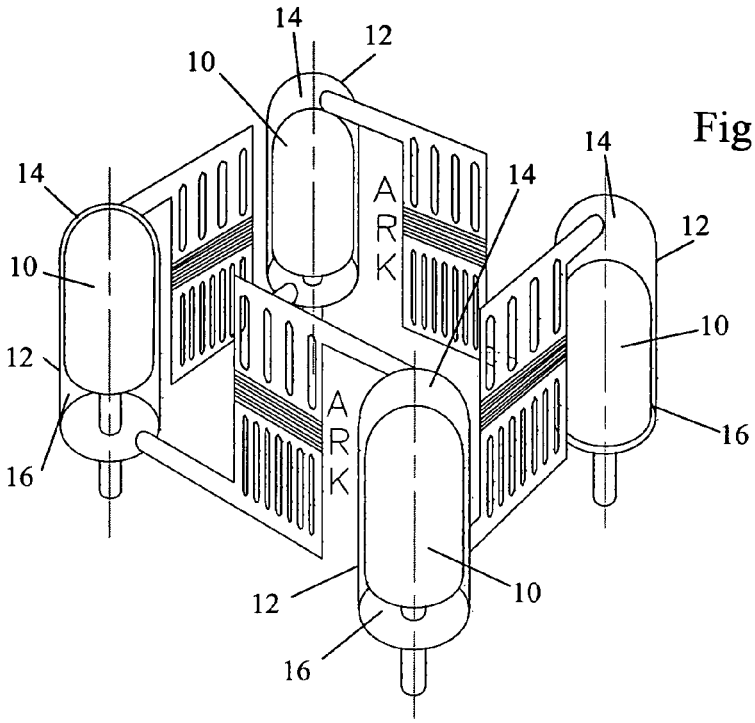
Fig. 1 Prior Art
FIG. 1 is a diagram of a prior art alpha configured Stirling machine in a box-four arrangement.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

Figure 4:
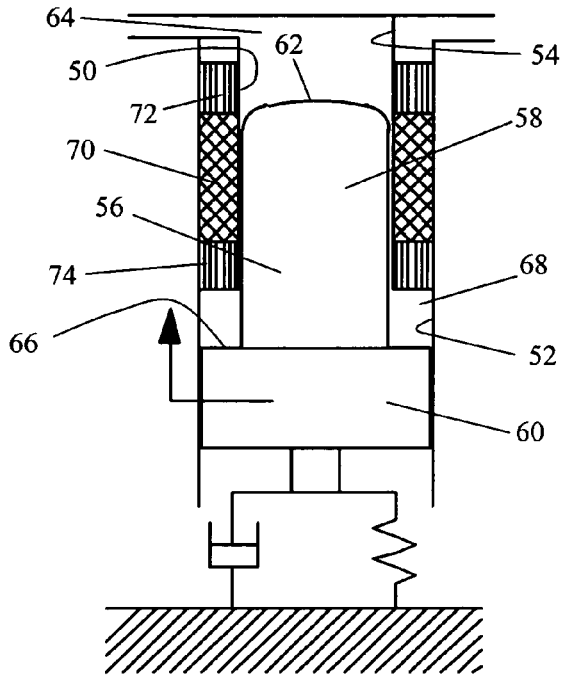
FIG. 4. is a diagram of a single element of an alpha configured, multi-piston Stirling machine embodying the present invention.

FIG. 4 illustrates a single $n^{th}$ element embodying the present invention for connection in a multi-cylinder, alpha configured, Stirling machine having n replications of the element of FIG. 4. A cylinder 50 is a stepped cylinder having a larger diameter interior wall 52 and a coaxial, smaller diameter interior wall 54. A piston 56 is a stepped piston comprising a first component piston 58 and a second component piston 60. The first component piston 58 is matingly reciprocatable in the smaller diameter cylinder wall 54 and has an end face 62 facing in one axial direction. In the illustrated embodiment, the end face 62 faces upwardly and bounds the expansion space 64. The second component piston 60 is matingly reciprocatable in the larger diameter, cylinder wall 52 and has an annular end face 66 that faces in the same axial direction as the end face 62. In the illustrated embodiment, the end face 66 bounds the compression space 68. Since the function of these spaces can be reversed, it is only necessary that one of the end faces bounds the compression space and the other end face bounds the expansion space. The piston is stepped and bounds, or defines a wall of, the two working spaces, namely, the compression space and the expansion space so that piston reciprocation varies the volume of these two spaces. FIG. 4 also shows a regenerator 70 and two heat exchangers 72 and 74 that are conventional except for their placement with respect to the stepped cylinder 50. They are in the connection paths to the expansion and compression spaces of other replications of the piston/cylinder element in order to connect the spaces in series in an alpha Stirling configuration as in the prior art.

Figure 15:
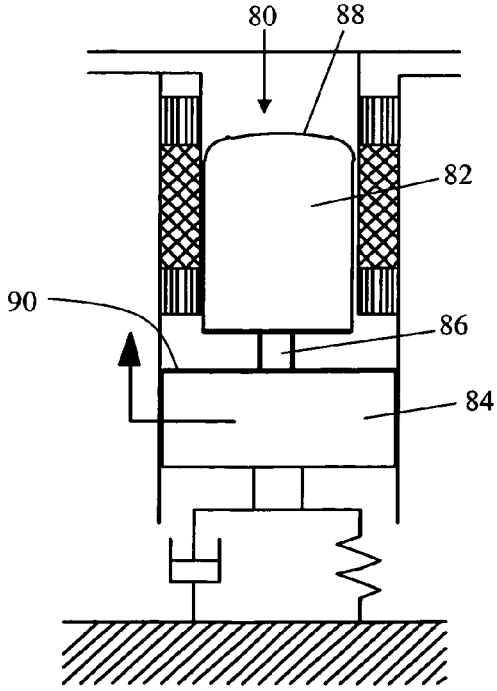
FIG. 15 is a diagram illustrating an alternative, possible embodiment of the invention.

The preferred stepped piston structure is as illustrated in FIG. 4. It has exterior, cylindrical walls that are axially adjacent and joined at a shoulder forming the end face 66 of the larger diameter component piston 60. However, other configurations are possible. It is not necessary that the piston components be adjacent with the end face 66 being a shoulder joining them. For example, FIG. 15 illustrates a stepped piston 80 having a smaller diameter piston component 82 and a larger diameter piston component 84 that are separated by a rod 86 connecting them together. The end faces 88 and 90 operate as described above but this embodiment has the disadvantage of introducing unnecessary dead space directly between the two component pistons which reduces efficiency and power. Similarly, the cylinders also can have interposed structural features instead of adjacent cylinder walls.

One critically important and valuable consequence of the stepped piston/cylinder structure of the present invention is the manner in which it changes the phase relationship between the expansion space volume and the compression space volume of the same cylinder. Another important and valuable consequence is that the stepped piston allows the expansion space and compression space volumes to be different and each designed for maximum performance. Conventional alpha machines have identical expansion and compression volume variations because the piston face acting upon each has the same diameter and the same displacement. However, with the stepped piston, there are two component pistons with differing diameters. Although they have the same linear displacement or stroke, the designer can select the two diameters of the two component pistons and thereby select two volume displacements, one for the expansion space and the other for the compression space.

Figure 3:
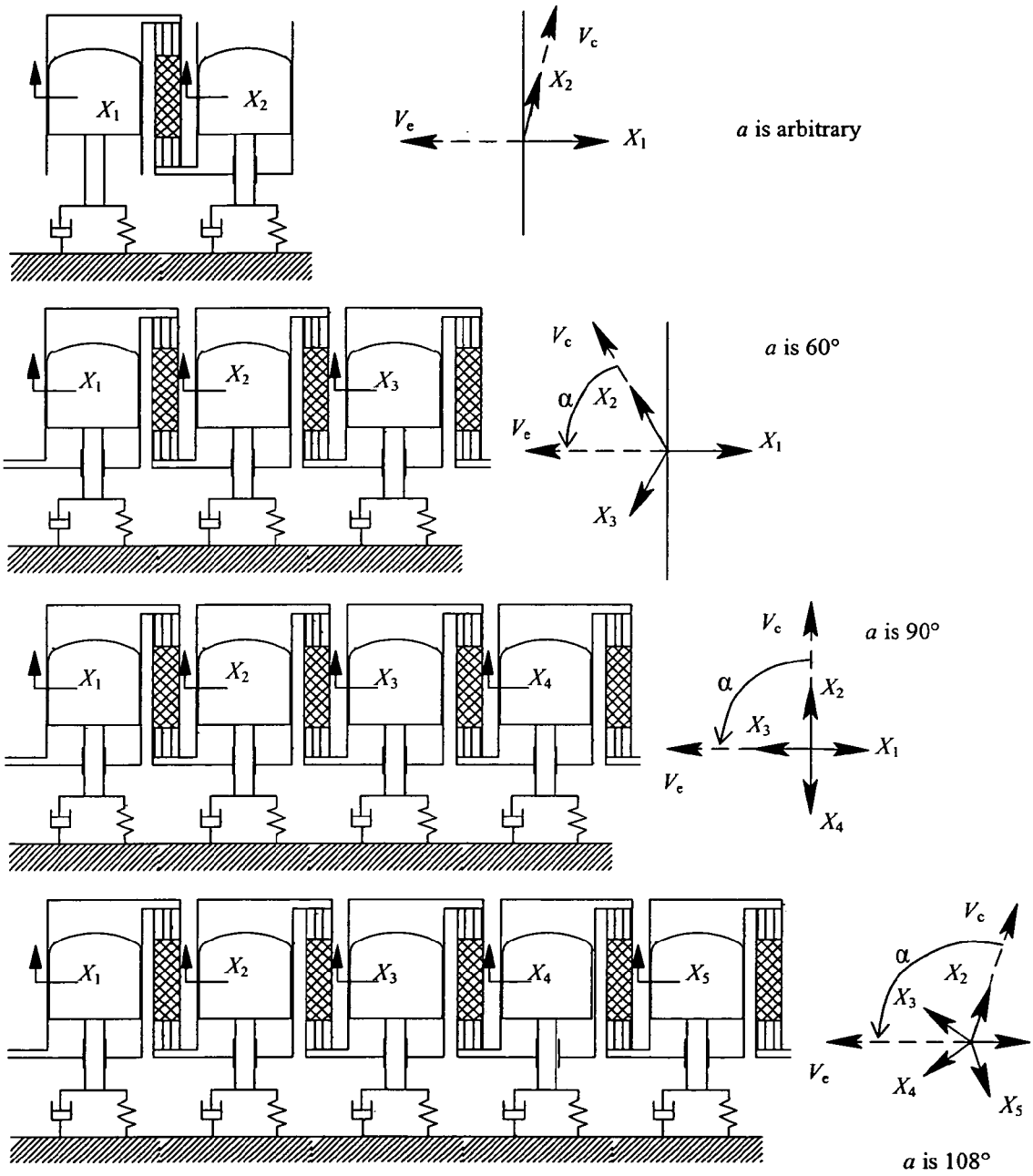
Fig. 3 Prior Art
FIG. 3 is a diagram of four possible, alternative, multi-piston alpha configured machines.
Figure 5:
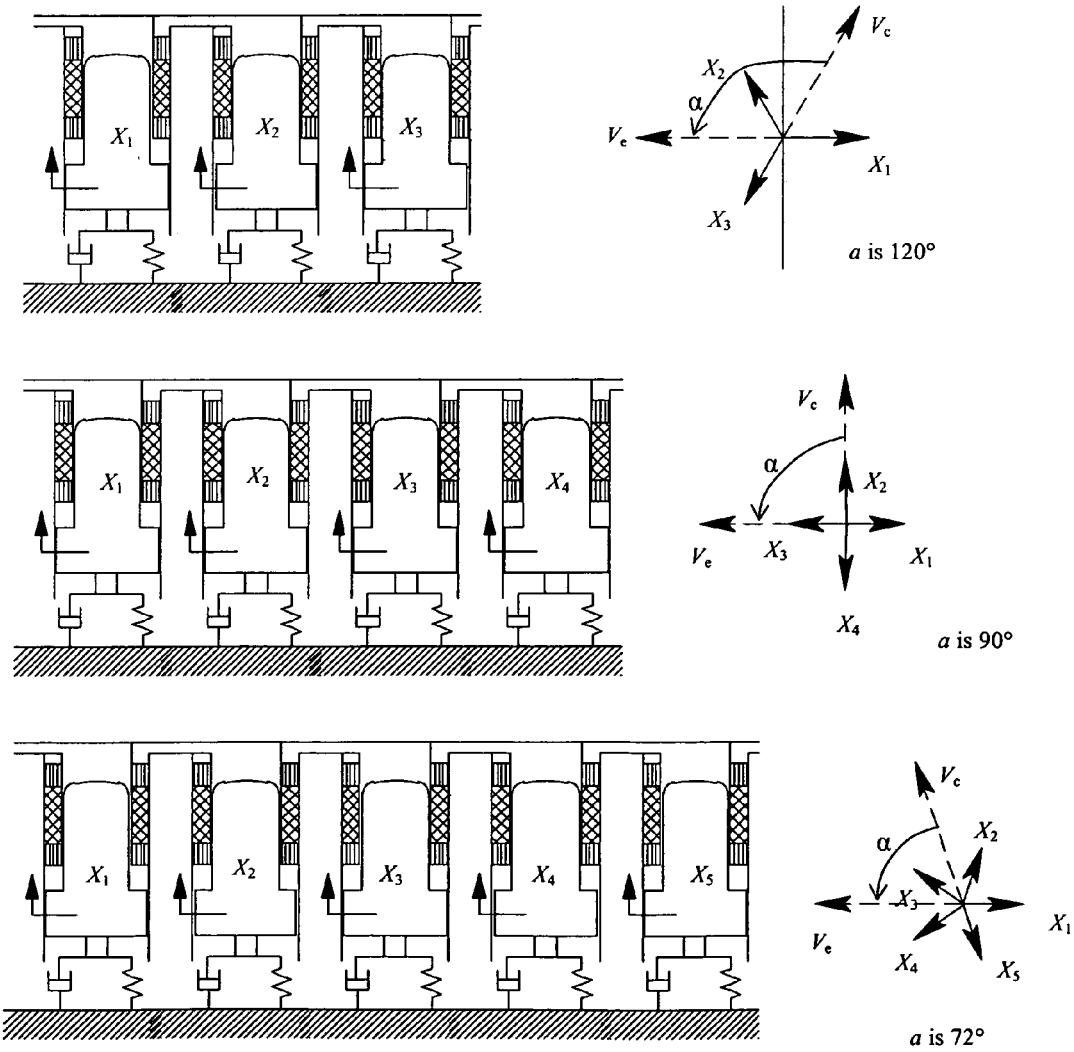
FIG. 5 is a diagram of three possible, alternative, multi-piston alpha configured machines embodying the present invention.

Comparison of the phasor diagrams of FIGS. 3 and 5 illustrates the phase change that results from the stepped piston. Each piston has two associated volume phasors, Vc for its compression space and Ve for its expansion space but not all are shown. The drawings of FIGS. 3 and 5 show two volume phasors, Vc and Ve, and they are an expansion volume phasor for one piston and the compression volume phasor for the compression space (of another piston) which is connected to that expansion space through a regenerator and heat exchangers. Only two representative volume phasors are illustrated on each phasor diagram because of space limitations. The angle between the volume phasor for the expansion space of one piston and volume phasor for the compression space of another piston to which that expansion space is connected is the volume phase angle $\alpha$. A complete, but undoubtedly unreadable, phasor diagram would have two volume phasors for each piston. There would be the same angle $\alpha$ between the phasors of each pair of connected expansion and compression spaces. It should be appreciated that "in phase" and "180° out of phase" depend upon which direction is chosen as the + displacement direction so that all phase observations are 180° different if the direction chosen as + is reversed.

Figure 2:
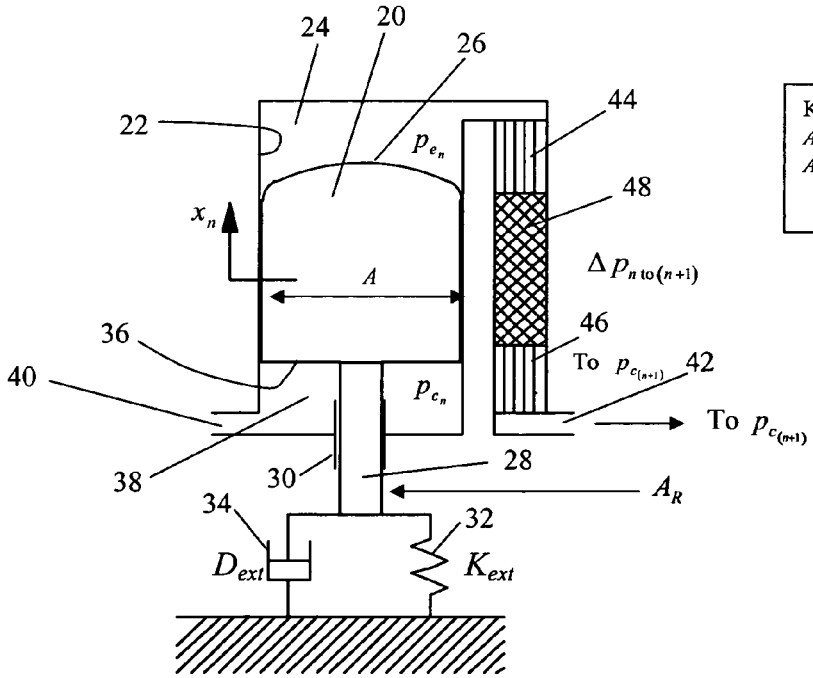
Fig. 2 Prior Art
FIG. 2 is a diagram of a single element of a prior art, alpha configured Stirling machine.

In the prior art illustrated in FIGS. 1–3, and referring to FIG. 2, one volume phasor is in phase with its piston's displacement and one is 180° out of phase with its piston's displacement. The volume of the expansion space 24 is in anti-phase with the piston displacement and the volume of the compression space 38 is in phase with the piston displacement. In other words, when the piston 20 is displaced in the positive direction (up in FIG. 2), the expansion space 24 volume decreases and the compression space 38 volume increases. This is also shown in the phasor diagrams of FIG. 3. For example, for the three piston implementation of the prior art, the displacement phasors $X_1$, $X_2$, and $X_1$ of the three pistons are separated by 120°. Volume phasors are shown for the expansion space of piston 1 and the compression space of piston 2, those two spaces being an example of two connected spaces. The volume phasor Ve for the expansion space of piston 1 is 180° out of phase with the displacement phasor $X_1$ for piston 1 but the volume phasor Vc for the compression space of piston 2 is in phase with the displacement phasor $X_2$ for piston 2. The phase difference is the volume phase angle of 60°. That is a very unfavorable volume phase angle.

However, with the present invention as illustrated in FIG. 5, the volume phase for both the expansion space and the compression space of the same cylinder are in anti-phase (180° out of phase) with the displacement of their associated piston. With the invention, both the expansion space volume and the compression space volume decrease as the piston moves in the positive direction (up in the figures). This difference in the phasing of the spaces of each cylinder enables an embodiment of the invention having only three cylinders to have the highly favorable 120° volume phase angle between the expansion space volume phase of one cylinder and the volume phase of the compression space to which it is connected. This allows efficient operation as a three-cylinder device unlike the conventional art, which is highly compromised in its three-cylinder form. The stepped piston arrangement offers the advantage of allowing a three moving part alpha arrangement with highly advantageous volume phasing. In order to get the volume phasing of 120° in the conventional art, the number of moving parts must be increased to six. That may be far too much complexity, particularly for small machines.

There are a variety ways of configuring multiple cylinder, free-piston, Stirling machines for being operable either as heat pumps or as engines (prime movers) and embody the stepped piston arrangement of the present invention. Many configurations are analogous to or modeled after prior art configurations depending upon the purpose of the particular machine. There is no mechanical driving mechanism or linkage, such as piston rods and cranks, joining the pistons of a free-piston machine. The moving parts are driven by gas forces in the case of the engine and by the linear motors in the case of a heat pump. Alternative loads may be attached to the pistons in the case of an engine, including another Stirling machine of the same configuration that would be driven as a heat pump (duplex arrangement).

For example, a three-cylinder, stepped piston arrangement would normally be configured triangularly, as is shown in FIGS. 6 and 7, with the three longitudinal axes laterally spaced apart and located at the apexes of an equilateral triangle. This gives the shortest distance between each cylinder and therefore the smallest dead volume. The embodiment of FIGS. 6 and 7 illustrates three identical Stirling heat pump elements driven by three linear motors. Only one of the three Stirling heat pump elements and one of the linear motor elements is described because the other two of each are identical. Their compression and expansion spaces are connected as described above and illustrated for the three cylinder embodiment of FIG. 5. The end face 78 of a stepped piston 81 bounds a cylindrical expansion space 83 and its annular shoulder forms an annular end face 85 bounding an annular compression space 87. As common in the prior art, a regenerator 89, a heat exchanger 91 for removing heat from a mass and a heat exchanger 92 for rejecting heat to a mass, all annularly surround the exterior of a cylinder 94. The stepped piston 81 is fixed to a reciprocating magnet carrier 96 having peripheral magnets 98 forming the reciprocating member of a conventional linear motor. The stepped piston 81 and the magnet carrier 96 are fixed to a central rod 98 that is attached to a planar spring 100. As known in the art, the main function of the spring 100 is to provide a centering force on the piston 81 to maintain a mean piston center position during operation. The gas forces acting on the piston act as a gas spring which, together with the planar spring 100, act upon the reciprocating mass to provide a resonant system. An armature winding 102 is wound annularly within the stationery housing 104 to form a stator of the linear motor.

Of course the Stirling machine illustrated in FIGS. 6 and 7 may be operated as a Stirling engine. The three linear motors that drove the three stepped pistons can be operated as three linear alternators to provide electric power generation or replaced by other loads, such as a refrigeration or air compressor or hydraulic or water pump As another example possible alpha Stirling configurations, FIG. 8 illustrates a four cylinder, inline version of the stepped piston, alpha arrangement that has some advantages in balancing. The stepped cylinders and pistons and the other structures of each piston/cylinder element are like those previously described and illustrated. The balancing advantage to minimize vibration is obtained by linking the cylinders slightly differently to that shown in FIGS. 3, 5, 6 and 7.

The four pistons 1, 2, 3, and 4 are arranged in an in-line, physical sequence of 1, 2, 3 and 4. The linking of the cylinder expansion and compression spaces is analogous to the 'firing order' of a regular internal combustion engine. In other words, since the 90° volume phase angle is always obtained with the four-cylinder version, it is possible to connect the compression space of cylinder 1 to the expansion space of cylinder 3, the compression space of cylinder 2 to the expansion space of cylinder 4, the compression space of cylinder 3 to the expansion space of cylinder 2 and finally the compression space of cylinder 4 to the expansion space of cylinder 1. This connection is referred to as a 1–3–2–4 connection versus the conventional art of 1–2–3–4 connection. The 1–3–2–4 connection is shown in FIG. 8 illustrated by the large, horizontal arrows.

Consider first the 1–2–3–4 connection. Pistons 1 and 3 are in anti-phase with each other and pistons 2 and 4 are in anti-phase with each other. So pistons 1 and 3 are 180° out of phase with each other and pistons are 2 and 4 are 180° out of phase with each other. The 1–3 combination results in a moment (or a couple) that is 90° out of phase with the 2–4 combination. This is shown in FIG. 9. Importantly, the length of the moment arm of each moment or couple is the distance between the axes of reciprocation of the pistons 1 and 3 or the pistons 2 and 4. This moment arm is the distance between two pistons separated by an interposed cylinder. These two moments (M13 and M24) combine to form the out-of-balance force impressed on the machine connected in the conventional 1, 2, 3, 4 sequence.

Now considering the 1–3–2–4 connection, it is clear that the two 180° couples are made up of adjacent piston assemblies resulting in M12 and M34 moments. Given similar moving masses in both cases, the moment arms in the 1–3–2–4 connection is about half the length of the moment arms in the 1–2–3–4 connection. Thus, the 1–3–2–4 connection has half the out-of-balance torque of the 1–2–3–4 connection as shown in FIG. 9. Of course, the 1–3–2–4 has a larger dead volume penalty owing to the longer connecting passages but this may not be a significant matter in most applications. This concept can also be applied to inline assemblies of non-stepped piston arrangements or conventional alpha configurations to improve balance and reduce vibration.

A number of driving or loading possibilities exist for the stepped piston as well as conventional alpha machines.

Linear motors or alternators can be connected to each piston. This requires three-phase current in the case of the three-cylinder version and two-phase current in the case of the four-cylinder version. Only two phases are needed since it is possible to wind two pairs of alternator coils in opposite directions so that the 180° oppositely phased voltages are automatically generated.

FIGS. 10 and 11 illustrate a first set of three, cylinder/piston elements 106, 108 and 110 connected in an alpha configuration as described above to form a first Stirling machine 111. They are connected to an opposed, mirror, second Stirling machine 113 also having three Stirling machine cylinder/piston elements 112, 114 and 116 connected in an alpha configuration as described above. The opposite pistons are connected by a linkage, such as the illustrated connecting rod 118. Thus, opposed and mirrored means that each element cylinder/piston and its associated heat exchangers and regenerator has an axially opposite and oppositely oriented element cylinder/piston and associated heat exchangers and regenerator, although it is not necessary that the two mirrored machines or elements be identical. Each pair of opposite pistons reciprocate in the same directions but when one piston is at top dead center its axially opposed piston is at bottom dead center. An opposed arrangement where one machine is an engine and the other is a heat pump is called a duplex arrangement. There can also be hybrid arrangements where both sides are opposed, mirror engines driving three or more common linear alternators or where both sides are opposed, mirror heat pumps driven by three or more common linear motors.

In the embodiment of FIGS. 10 and 11, a plurality of prime movers or loads, such as motor or linear alternator 120, are each drivingly connected to a different piston linkage, such as connecting rod 118, and preferably are positioned in the space between the pistons. In FIG. 10, only one element of each of the opposed Stirling machines is illustrated and described because the other two elements of each are identical. Each element has the components previously described. A stepped piston 122 matingly slidable in a cylinder 123 is connected by a connecting rod 118 to its opposed stepped piston 124 that is matingly slidable in its cylinder 125. The prime mover or load 120 is a stationary, annular, armature winding 126 with magnets 128 fixed to a moving inner iron 129 which is in turn fixed to the connecting rod 118. This structure can be a load when operated as a linear alternator and the opposed Stirling machines are operated as Stirling engines to drive the magnets 128 in reciprocation. This same structure can be a linear motor when an alternating voltage is applied to the armature winding 126 and drives the Stirling machines operated as a Stirling heat pump.

The three cylinders of each of the opposed Stirling machines are physically arranged with three, parallel, longitudinal axes of reciprocation arranged at the apexes of an equilateral triangle. This permits both Stirling machines to exhibit the same advantages described in connection with the similar arrangement shown in FIGS. 6 and 7. Additionally, by constructing a second Stirling machine in opposition to a first Stirling machine, only one set of linear motors or alternators are be needed so they provide double duty, with each driving or being driven by two pistons. Consequently, the weight and expense of providing one linear alternator or linear motor for each piston is avoided.

Similarly, opposed Stirling machines each having four pistons and cylinders, can be constructed in the same manner, in a box-four arrangement or inline arrangement as previously described, and yet they require only four linear alternators or linear motors. This gains the advantages previously described in connection with the four cylinder arrangements according to the invention and also halves the number of alternators or motors.

In addition, because the opposed Stirling machines illustrated in FIGS. 10 and 11 can each be operated as a Stirling engine or a Stirling heat pump, one can be operational as an engine and the other operational as a heat pump. Consequently, the embodiment of FIGS. 10 and 11 can be a duplex arrangement, with the Stirling engine driving both the Stirling heat pump and an alternator. As another alternative, the interposed alternator may be eliminated to provide a duplex arrangement with the Stirling engine driving only a Stirling heat pump.

The four cylinder embodiments described above can also be connected in the same duplex arrangement to obtain the advantages of both. In fact, the opposed and duplex arrangements described above can also be applied to and used with conventional, prior art, alpha configurations that do not use the stepped pistons and cylinders of the present invention.

Figure 12:
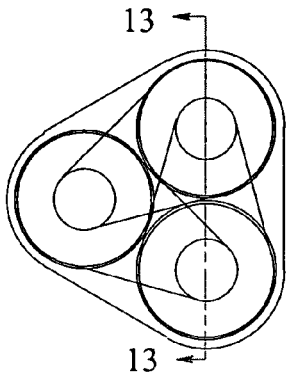
FIG. 12 is an end view of a Stirling engine embodying the invention and driving a Rankine compressor load.
Figure 13:
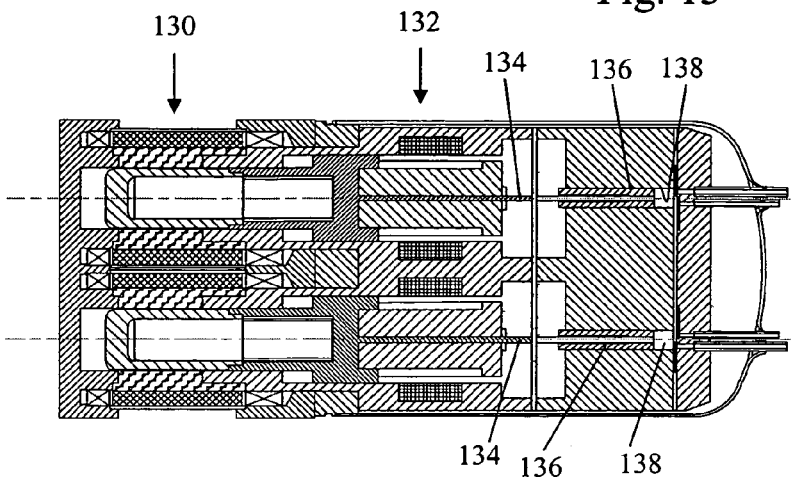
FIG. 13 is a view in section of the embodiment illustrated in FIG. 12 taken substantially along the line 13—13 of FIG. 12.
Figure 14:
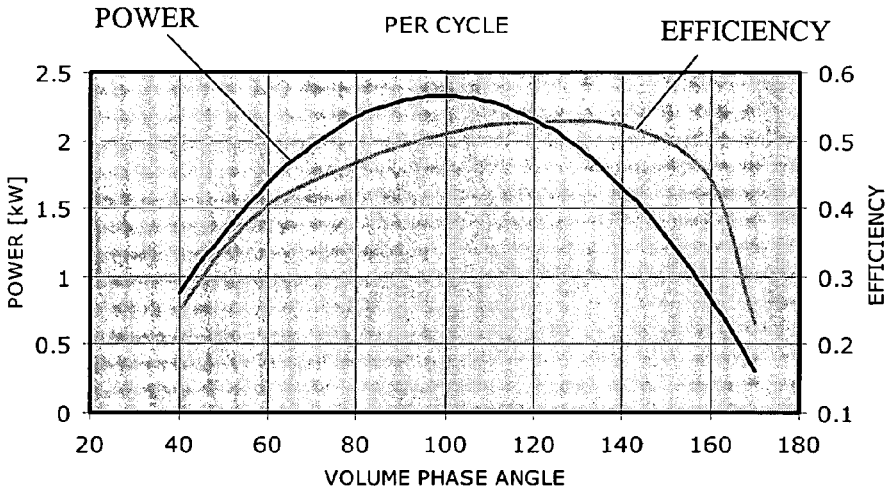
FIG. 14 is a pair of graphs of power and efficiency as a function of volume phase angle.

FIGS. 12 and 13 show that a number of Rankine compressors equal to the number of Stirling engine pistons can each be directly driven by an alpha free-piston engine. In this case, the mixing of the working gases would be managed as has been disclosed in U.S. Pat. No. 6,701,721, herein incorporated by reference. Referring to FIGS. 12 and 13, a Stirling engine 130 is connected to drive a linear alternator 132 and the engine and alternator combination is constructed as described for the Stirling heat pump and linear motor of FIGS. 6 and 7 and therefore is not further described. There are three engine/alternator pairs arranged along three longitudinal axes as described for FIGS. 6 and 7. Additionally, however, the central piston rod 134 is also connected to a compressor piston 136 sealingly reciprocatable within a compressor cylinder 138. With this arrangement, the efficient, three cylinder, alpha configured Stirling engine drives both the alternators and the compressors to convert the heat energy applied to the engine to both electrical power and refrigeration. This can be useful because the compressor is not always able to absorb all of the power produced by the Stirling engine. So the alternator can be used as a mechanical energy absorbing load stabilizer by balancing the combined load of the compressor and alternator to the power developed by the Stirling engine. The alternator is also useful to start the engine since it works equally as well as a motor.

From the above descriptions of the embodiments of the invention, it can be seen that the three-cylinder stepped piston alpha arrangement has the following advantages over the previous art:

a. In comparison to the conventional beta configurations (the standard piston-displacer arrangement), the three-cylinder alpha stepped piston arrangement has the advantage of having three identical moving components whereas the beta arrangements usually have three different moving components, a piston, a displacer and a resonant balance mass.

b. It has a far better volume phase angle (for best power and efficiency combination) compared to a three or four-cylinder conventional alpha arrangement. It will therefore be a far more compact arrangement.

c. It is balanced in the axial motion direction because as much mass moves positively as moves negatively. There is a nutating out-of-balance force but this is far less serious than the rather large linear out-of-balance force of an unbalanced beta machine.

d. It will have a force couple on the system causing a net nutating or precessing motion about a fixed point. This would depend on how the cylinders are arranged. If arranged as in FIGS. 6 and 7, then the out-of-balance forces will cause a nutating couple on the system. This may be balanced by a number of simple conventional means.

e. The stepped piston allows the expansion space and compression space volumes to be arbitrarily chosen for maximum performance. Conventional alpha machines have almost identical expansion and compression volume variations.

f. There are only three identical moving parts. If perfect balance is required, a second machine can be placed in opposition or a balance mass system may be employed. A balance mass system may be a simple bob-mass on the end of a cantilever spring designed to resonate in a nutating mode at the operating frequency of the machine.

g. The machine has no tuning difficulty. If the thermodynamics are good and the mechanical efficiency is good, the machine will run as an engine or operate as a heat pump. Operating slightly above or at the natural resonance of the machine will be the most favorable operating point for the design of the linear motor. This resonance point is given by: $\omega_0=\sqrt{K/m}$ in radians per second.

Where:

m is the mass of a piston

K is the net spring force on the piston due to gas pressures and external springs, given by:

$$K \equiv K_{ext} A_e \frac{\partial p_{c_{n-1}}}{\partial x_n} + A_c \frac{\partial p_{c_n}}{\partial x_n}$$

Where:

$K_{ext}$ is the external spring on the piston, usually mechanical.

$A_e$ is the expansion space area of the piston $A_c$ is the compression space area of the piston $$\frac{\partial p_{c_{n-1}}}{\partial x_n}$$

is the pressure change in the previous cylinder with respect to the piston motion.

$$\frac{\partial p_{c_n}}{\partial x_n}$$

is the pressure change with respect to the piston motion.

h. The machine is truly reversible. If driven in one direction it will pump heat from one side to the other. If the motion is reversed, the functions of the expansion and compression spaces are exchanged and so it will pump heat in the opposite direction. If released, it will run as an engine according to the temperature differential across the machine.

Other general advantages of the alpha arrangement that are not specific to the three-cylinder stepped piston machine but nonetheless have never been identified before are:

a. If a second machine is placed in opposition, then only one set of linear motors or alternators will be needed at double duty. For example, a four cylinder opposed machine requires only four linear motors or alternators despite having eight cylinders.

e. Duplex or double cylinder arrangements are easily formed by the addition of a second machine in opposition to the first.

f. Balancing of the nutating couple is possible with a bob-mass on the end of a cantilever spring.

While certain preferred embodiments of the present invention have been disclosed in detail, it is to be understood that various modifications may be adopted without departing from the spirit of the invention or scope of the following claims.

The invention claimed is:

1. An improved, free-piston, alpha configuration, Stirling machine having at least three pistons and at least three cylinders, each piston reciprocatable in a mating cylinder, each piston and cylinder bounding an expansion space and a compression space in each cylinder, the expansion space in each cylinder being series connected in an alpha Stirling configuration through a regenerator to a compression space in another cylinder and the compression space in each cylinder being series connected in an alpha Stirling configuration through a regenerator to the expansion space in another cylinder, wherein the improvement comprises:

(a) each cylinder being a stepped cylinder having a relatively larger diameter interior wall and a coaxial, relatively smaller diameter interior wall;

(b) each piston being a stepped piston comprising
  (i) a first component piston having a first end face facing in one axial direction and matingly reciprocatable in the smaller diameter cylinder wall; and
  (ii) a second component piston having a second end face facing in the same axial direction as the first end face and matingly reciprocatable in the larger diameter, cylinder wall; and
(c) one of said end faces of each piston bounding the compression space in the cylinder in which the piston reciprocates and the other said end face of each piston bounding the expansion space in the cylinder in which the piston reciprocates.

2. A Stirling machine in accordance with claim 1 wherein the stepped piston has peripheral, cylinder walls that are axially adjacent and joined at a shoulder forming the end face of the larger diameter component piston.

3. A Stirling machine in accordance with claim 1 or 2 wherein the Stirling machine comprises three and only three cylinders and associated stepped pistons.

4. A Stirling machine in accordance with claim 3 wherein the three cylinders are physically arranged with three, parallel, longitudinal axes of reciprocation arranged at the apexes of an equilateral triangle.

5. A Stirling machine in accordance with claim 1 or 2 wherein the Stirling machine comprises four cylinders and associated stepped pistons.

6. A Stirling machine in accordance with claim 5 wherein the cylinders are arranged in-line in a physical sequence of 1, 2, 3 and 4 and wherein the expansion and compression spaces are series connected in an alpha configuration in the sequence 1, 3, 2, 4 whereby adjacent pair 1 and 2 operate 180° out of phase with each other and adjacent pair 3 and 4 operate 180° out of phase with each other.

7. A Stirling machine in accordance with claim 1 or 2 and further comprising:
(a) an opposed, mirror second Stirling machine constructed as described in claim 1 or 2, each stepped piston of a first Stirling machine connected by a linkage to a stepped piston of the second Stirling machine; and
(b) a plurality of prime movers or loads, each prime mover or load drivingly connected to a different linkage.

8. A Stirling machine in accordance with claim 7 wherein the opposed Stirling machines are operational as Stirling engines and a linear alternator is connected as a load to each linkage.

9. A Stirling machine in accordance with claim 8 wherein each of the opposed Stirling machines has three and only three pistons and cylinders.

10. A Stirling machine in accordance with claim 9 wherein the three cylinders of each Stirling machine are physically arranged with three, parallel, longitudinal axes of reciprocation arranged at the apexes of an equilateral triangle.

11. A Stirling machine in accordance with claim 8 wherein each of the opposed Stirling machines has four pistons and cylinders.

12. A Stirling machine in accordance with claim 7 wherein the opposed Stirling machines are operational as Stirling heat pumps and a linear motor is connected as a prime mover to each linkage.

13. A Stirling machine in accordance with claim 12 wherein each of the opposed Stirling machines has three and only three pistons and cylinders.

14. A Stirling machine in accordance with claim 13 wherein the three cylinders of each Stirling machine are physically arranged with three, parallel, longitudinal axes of reciprocation arranged at the apexes of an equilateral triangle.

15. A Stirling machine in accordance with claim 12 wherein each of the opposed Stirling machines has four pistons and cylinders.

16. A Stirling machine in accordance with claim 1 or 2 and operational as a Stirling engine and further comprising an opposed, second Stirling machine constructed as described in claim 1 or 2, operational as a Stirling heat pump and connected to form a duplex configuration, each stepped piston of the Stirling engine connected by a linkage to a stepped piston of the Stirling heat pump.

17. A Stirling machine in accordance with claim 16 wherein each of the opposed Stirling machines has three and only three pistons and cylinders.

18. A Stirling machine in accordance with claim 17 wherein the three cylinders of each Stirling machine are physically arranged with three, parallel, longitudinal axes of reciprocation arranged at the apexes of an equilateral triangle.

19. A Stirling machine in accordance with claim 18 wherein each of the opposed Stirling machines has four pistons and cylinders.

* * * * *